US006569821B1

(12) United States Patent
Ibrahim et al.

(10) Patent No.: US 6,569,821 B1
(45) Date of Patent: May 27, 2003

(54) OVERBASED METAL DETERGENTS

(75) Inventors: Tuncel Ibrahim, Abingdon; John A Cleverley; Phillip Skinner, both of Didcot; Jane Rachel Galsworthy, Abingdon; Christopher John Adams, Reading, all of (GB); Rudi ter Haar, Heiloo (NL)

(73) Assignee: Infineum USA L.P., Linden, NJ (US)

( * ) Notice: Subject to any disclaimer, the term of this patent is extended or adjusted under 35 U.S.C. 154(b) by 0 days.

(21) Appl. No.: 09/476,512

(22) Filed: Jan. 3, 2000

(30) Foreign Application Priority Data

Jan. 4, 1999 (GB) ..... 9900035

(51) Int. Cl.[7] ..... C10M 159/20; C10M 159/22

(52) U.S. Cl. ..... 508/396; 508/435; 508/460; 508/574; 508/586

(58) Field of Search ..... 508/396, 435, 508/460, 574, 586

(56) References Cited

U.S. PATENT DOCUMENTS 3,714,042 A * 1/1973 Greenough
3,755,172 A * 8/1973 Woods et al.
4,212,752 A * 7/1980 Peditto et al.
4,347,147 A * 8/1982 Allain et al.
4,749,499 A * 6/1988 Damin et al.
4,758,360 A * 7/1988 Bernasconi et al.
4,839,094 A * 6/1989 March et al.
5,037,565 A * 8/1991 King
5,486,300 A * 1/1996 Salomon et al.

FOREIGN PATENT DOCUMENTS

EP 0 609 623 A1 8/1994 ..... C10M/163/00
EP 0 645 444 A2 3/1995 ..... C10M/159/20

* cited by examiner

*Primary Examiner*—Jerry D. Johnson

(57) ABSTRACT

An overbased metal detergent having friction-modifying properties comprises colloidal inorganic base particles stably dispersed in an oil of lubricating viscosity. The colloidal particles constitute from 15 to 40 mass % of the detergent, and a stabilizing system constitutes from 20 to 45 mass % thereof, the balance being the oil of lubricating viscosity. The stabilizing system is the mixture obtained by combining an oil-soluble detergent component and from 25 to 75 mass % of an aliphatic amide having from 10 to 30 carbon atoms.

17 Claims, 2 Drawing Sheets

OVERBASED METAL DETERGENTS

Figure 1:
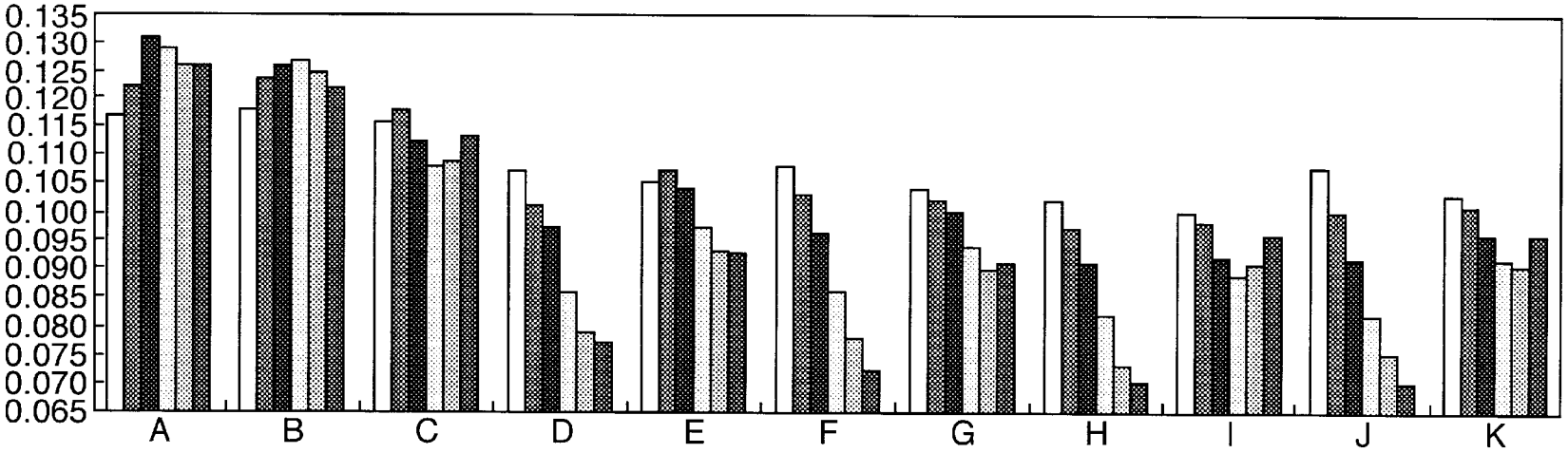

This invention relates to colloidal overbased metal detergents stabilised by a mixture of surfactant anions, and having advantageous properties when used in oleaginous compositions, particularly in lubricating compositions, more especially compositions suitable for use in internal combustion piston engine, especially gasoline (spark-ignited) and diesel (compression-ignited), crankcase lubrication, such compositions being referred to as crankcase lubricants.

A crankcase lubricant is an oil used for general lubrication in an engine, such as an automobile or truck engine, where there is an oil sump below the crankshaft of the engine and to which circulated oil returns.

Overbased metal detergents are generally salts or complexes having a large excess of basic metal cation over that required to neutralize the oil-soluble anionic component of the detergent. They may be prepared in colloidal form by heating a mixture of an oil-soluble detergent material, such as a hydrocarbyl sulphonate or hydrocarbyl sulphonic acid, with an alkaline earth or alkali metal compound in stoichiometric excess over that required to neutralize the detergent material, and then forming a dispersion of basic particles by reacting the excess metal compound with an acidic species, preferably carbon dioxide. The resulting overbased metal detergent product consists of a colloidal dispersion of basic particles, such as calcium carbonate, stabilised by a protective layer of the detergent.

Overbased metal detergents are widely used as additive components in lubricants, particularly crankcase lubricants. Such a hostile environment subjects the base oil of the lubricant to high temperatures, high shear stress and chemical attack from fuel combustion products.

Under such conditions, the combustion products are corrosive and degrade the lubricant. Acids resulting from fuel combustion or oil oxidation are particularly damaging to the proper functioning of the engine and must be neutralised. In addition to containing overbased metal detergents to perform this function, lubricants need to contain a variety of other auxiliary additives (or co-additives) performing a variety of functions. Such additives have to be sufficiently compatible to ensure that the lubricants can be prepared without undue processing difficulties, and that the resulting products remain sufficiently compatible during storage, transport and end-use to remain effective. A particular problem is preparation of a concentrate of additives in an oleaginous carrier fluid (a so-called 'adpack') for subsequent introduction into a finished lubricant for use in the intended working environment.

Typically, a lubricant suitable for example, for crankcase lubrication, not only requires adequate protection against combustion and degradation products, but also includes friction modifiers to improve fuel economy. Aliphatic amides and their derivatives constitute a class of compounds that is frequently included in lubricants to provide friction modification.

The preparation of a concentrate containing both overbased metal detergents and an aliphatic amide gives rise to a number of problems. Firstly, the amides are solid at room temperature: thus, it is difficult to disperse an effective amount of the amide in the detergent-containing oil. Secondly, and of much more significance, the addition of the amide to detergent-containing oils can readily result in destabilisation of the concentrate, particularly at increased amide concentrations. The aliphatic amides have strong surface activity, so that, on addition to carrier oils containing overbased detergents, the aliphatic amide molecules will compete with the molecules of detergent for occupancy of the surface of the dispersed inorganic particles. It has been observed that, on storage of this composition, the competition and interchange between surface active molecules can result in destabilisation, manifested by haze or sediment appearing in the oil. This antagonistic effect of the amide severely limits the amount of amide that can be added to overbased detergent-containing oils, and as a consequence, limits the friction-modifying benefits that would be obtained at higher amide concentrations. Typically, concentrates containing from 1.5 to 3.0 mass % of overbased detergent start to destabilise when more than about 0.15 mass % of amide is added.

EP-A-0 645 444 discloses lubricants containing linear alkaryl overbased detergents, optionally containing friction modifiers such as fatty acid esters and amides and glycerol esters of dimerised fatty acids. Although such combinations are not exemplified there is no indication in the description that the mixtures are anything other than simple mixtures of the preformed components.

EP-A-0 609 623 discloses engine oil compositions comprising a neutral or overbased metal detergent, an ashless dispersant and an antiwear agent comprising a mixture of an aliphatic amide and either a dithiocarbamate compound or an ester derived from a fatty acid and boric acid. The compositions are described in the Examples as simple admixtures of these components and, as such, will be subject to the problems described above.

Overbased metal detergents have now been devised in which a friction-modifying amide component is incorporated as an integral step in the preparation of the overbased detergent. This procedure for introducing a friction-modifying function into the lubricant composition avoids or significantly reduces the extent of the problems referred to above and provides a number of additional unexpected advantages.

In a first aspect, the invention provides an overbased metal detergent having friction-modifying properties comprising a stable, colloidal dispersion of inorganic base particles in an oil of lubricating viscosity, wherein the detergent comprises i) from 15 to 40 mass % of collodial particles;

ii) from 20 to 45 mass % of a stabilising system comprising the mixture obtained by combining A) at least one oil-soluble detergent component having an anionic moiety selected from sulfonate, phenate, sulfurised phenate, thiophosphonate, salicylate, carboxylate, or naphthenate, and B) at least one aliphatic amide having from 10 to 30, preferably 16 to 24, carbon atoms, constituting from 25 to 75, preferably 30 to 60, more preferably 35 to 55, mass % of the mixture; and iii) the oil of lubricating viscosity as the balance.

By "stably dispersed" is meant that, after the detergent has been subject to storage at ambient temperature for extended periods, for example for 4, preferably 8, weeks, it is free from haze and contains no more than 0.05% by volume of sediment.

It will be appreciated that, although the detergent of the invention is formed by admixing the two surface active components A) and B), as defined above, it is likely that at least part of each component charge will be chemically changed as a result of subsequent reaction within the system, so that the term "the mixture obtained by combining" includes the products resulting from the subsequent reaction of the components.

In a second aspect, the invention provides a method of making an overbased metal detergent comprising stably dispersing colloidal inorganic base particles in an oil of lubricating viscosity, using a mixture of at least one oil-soluble sulphonate, phenate, sulfurised phenate, thiophosphonate, salicylate, carboxylate, or naphthenate, with at least one oil-soluble aliphatic amide having from 10 to 30, preferably from 16 to 24, carbon atoms.

The detergent of the invention not only provides a lubricant with the ability to neutralize acidic materials formed in the operation of an automotive engine, but also provides a significant measure of friction modification thereto. Surprisingly, although the amide provides a contribution to the stabilisation of the colloidal particles, and is consequently intimately associated with the stabilising layer around the colloidal particles, the amide evidently also becomes available as a friction modifier at the metal-to-metal contact areas of the operating engine. In fact, detergents of the invention, prepared by incorporating the aliphatic amide as an integral step in the process of providing a stably dispersed overbased detergent, have been found to exhibit improved friction modification properties in comparison with detergents of the same overall composition prepared by simple mixing of a preformed overbased detergent and an aliphatic amide.

The detergents of the invention also have a remarkable compatibility, and in some cases synergy, with other functional additives (or co-additives) commonly used in lubricants. This is particularly marked when the co-additive is a metal dihydrocarbyl dithiophosphate. The inclusion of a low concentration of such a co-additive results in extremely low values of boundary lubrication friction coefficients, particularly when measured at elevated temperatures, such as, 80 to 120° C. The concentration of dithiophosphate may be such that the mass ratio of the detergent of the invention to the metal dihydrocarbyl dithiophosphate is in the range from 25:1 to 1:2, preferably from 12:1 to 1:1, more preferably from 5:1 to 2:1. Preferred forms of the detergent enable extremely low boundary lubrication friction coefficients to be achieved, particularly at elevated temperatures of 80° C. and above. Thus, boundary lubrication friction coefficients of less than 0.1 at 80° C. and of less than 0.09, preferably less than 0.08, at 120° C. can readily be achieved with detergents of the invention. It has not been possible, previously, to achieve such low friction coefficients using only aliphatic amides as the friction modifier; such low values were generally only obtained by including a more expensive molybdenum-containing friction modifier in the lubricant. Thus, a preferred such detergent of the invention is free of any molybdenum-containing component.

The boundary lubrication friction coefficients referred to above and given in the examples hereinafter are determined according to the method described in the Proceedings of the International Conference, Yokohama, October 29 to November 2, pages 817 to 822. This paper details the use of a High Speed Reciprocating Rig (HFRR) for the measurement of boundary lubrication friction coefficients.

The art describes a variety of methods for producing conventional overbased metal detergents. The products generally consist of dispersions of inorganic base particles, such as metal carbonate particles, in a hydrocarbon oil, stabilised with an adsorbed layer of surfactant, and are prepared under conditions such that the carbonate, for example, is formed by chemical reaction from the metal oxide and/or hydroxide in the presence of a surfactant.

A preferred method of preparing the detergent of the invention comprises the steps of (a) neutralising (i) an oil-soluble detergent component selected from at least one of sulphonate, carboxylate, phenate, sulphurised phenate, thiophosphonate, salicylate and naphthenate, with a stoichiometric excess of (ii) an alkaline earth or alkali metal oxide and/or hydroxide, in the presence of a volatile hydrocarbon solvent, water, a polar material and a non-volatile hydrocarbon oil, (b) adding at least one aliphatic amide having from 10 to 30, preferably 16 to 24, carbon atoms to the neutralised product, (c) reacting the product of step (b) with a gaseous acidic species, preferably carbon dioxide, and (d) removing the volatile hydrocarbon solvent, polar material and water.

The polar material used is typically a monohydric alkanol having from one to four carbon atoms. The presence of the combination of polar material and the water enables the neutralised product to be solubilised in the reaction medium. As carbonation proceeds, the hydroxide is converted into colloidal particles dispersed in the mixture of volatile hydrocarbon solvent and non-volatile hydrocarbon oil. The presence of a significant amount of non-volatile oil is necessary to solubilise the aliphatic amide and make it available as a surface-active material on the colloidal particles. After completion of the reaction, the volatile hydrocarbon solvent and the polar material may be removed by distillation.

The detergents of the invention may be prepared using a variety of other methods in which known methods of forming overbased detergents are adapted so that at least one aliphatic carboxylic acid or amide having from 10 to 30, preferably 16 to 24, carbon atoms is included in the reaction mixture after the neutralisation step and prior to carbonation.

In all the methods used, the amide is used to replace part of the detergent normally present in preparing stably dispersed colloidal overbased metal detergents. The relative proportions of detergent to amide are mainly determined by the overriding requirement of obtaining a stable dispersion of the combination of amide and colloidal overbased metal detergent particles, which will remain stable during storage, transport and end-use. These requirements are met when the amide represents from 25 to 75 mass % of the total of amide and detergent. Preferably, the amide represents from 30 to 60, more preferably 35 to 55, mass % of the total.

When the amide is present within the above ranges, it not only provides the necessary additional stabilisation of the base particles, but also contributes a significant friction-modifying effect to the resulting detergent.

The aliphatic amides of use in the invention are preferably linear amides. Particularly suitable amides are oleamide, stearamide and erucamide, although oleamide is preferred.

The acidic species, preferably low molecular weight, may be selected from carbon dioxide, sulphur dioxide and sulphur trioxide. Carbon dioxide is preferred. Preferably, the alkaline earth metal is calcium or magnesium. Sodium is the preferred alkali metal. Mixtures of metals may be used.

The preferred detergent components have hydrocarbyl groups comprising alkyl groups containing from 3 to 70 carbon atoms, or alkaryl groups containing from 9 to 80, preferably 16 to 60, carbon atoms per alkyl-substituted aromatic moiety. The preferred anions of the detergents are sulphonates, phenates, sulphurised phenates and mixtures thereof.

The sulphonates may be prepared from sulphonic acids, which are typically obtained from the sulphonation of alkyl-substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene.

The basicity of the detergents of the invention is preferably expressed as a total base number (TBN). A total base number is the amount of acid needed to neutralize all of the basicity of the overbased material. The amount of acid is expressed as the equivalent amount of potassium hydroxide. The TBN may be determined according to ASTM D 2896. Preferred materials according to the invention have a TBN of at least 150, preferably up to 450 or more. Particularly preferred are calcium sulphonates, calcium carboxylates, such as naphthenates, calcium phenates and calcium sulphurized phenates having a TBN of between 150 and 450.

The detergents of the invention do not exclude the presence of conventional overbased metal detergents, but acceptable performance can normally be achieved without the need for such additional detergents.

As previously indicated, commercial lubricants need to include a substantial range of additives, each performing a function to meet the stringent requirements demanded of modern day lubricants. One of the most significant of these is the ashless dispersant which must be present to keep the solid and liquid contaminants, formed during the working life of the lubricant, in suspension. The combination of the ashless dispersant with the other lubricant additives, particularly the detergent gives rise to further potential interaction problems. A further advantage of the detergents of the present invention is that, in some combinations of dispersant and detergent, the extent of this adverse interaction has been observed to be reduced in comparison with the use of conventional overbased detergents. This is particularly noticeable when the dispersant is of high number average molecular weight (Mn), for example, where the dispersant has an oil soluble hydrocarbon backbone with an Mn of at least 1500, preferably at least 2500, more preferably at least 3000, and not greater than 10,000. As indicated, the detergents of the invention will eventually be present, in end use, in diluted form in combination with the oil of lubricating viscosity which it protects and modifies. For convenience of handling and transporting, the detergents of the invention may also be present in concentrated form in a diluent (or carrier oil), which may be the same oil which is to be protected.

Thus, a third aspect of the invention is a lubricant comprising, or made by admixing or a mixture of, a major amount of an oil of lubricating viscosity and a minor amount of a detergent of the first aspect of the invention.

A fourth aspect of the invention is a concentrate for a lubricant which comprises a detergent of the first aspect of the invention in solution or in dispersion in a diluent therefor, such as an oil of lubricating viscosity. There may be present a major amount of detergent and a minor amount of oil.

Co-Additives

As indicated, other known additives may be incorporated into lubricants together with the detergents of the invention. They may, for example, include dispersants; other detergents, e.g. single or mixed detergent systems; rust inhibitors; anti-wear agents; anti-oxidants; corrosion inhibitors; friction modifiers or friction reducing agents; pour point depressants; anti-foaming agents; viscosity modifiers; and surfactants.

They can be combined in proportions known in the art.

As is known in the art, some additives can provide a multiplicity of effects; thus, for example, a single additive may act as a dispersant and as an oxidation inhibitor.

Certain classes of co-additive will be discussed in more detail as follows:

Dispersants

A dispersant is an additive for a lubricant whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricant, thus preventing sludge flocculation and precipitation or deposition on metal parts of the engine.

Dispersants are usually "ashless", being non-metallic organic materials that form substantially no ash on combustion, in contrast to metal-containing, and hence ash-forming, materials. They comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil-soluble salts, esters, amino-esters, amides, imides, and oxazolines of long chain hydrocarbon-substituted mono- and dicarboxylic acids or their anhydrides; thiocarboxylate derivatives of long chain hydrocarbons; long chain aliphatic hydrocarbons having a polyamine attached directly thereto, and Mannich condensation products formed by condensing a long chain substituted phenol with formaldehyde and polyalkylene polyamine, such as described in U.S. Pat. No. 3,442,808.

The oil-soluble polymeric hydrocarbon backbone is typically an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil-soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an $\alpha,\overline{\omega}$-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomers typically having an $\overline{Mn}$ of from 700 to 5000 may also be used, as described in EP-A-490454, as well as heteropolymers such as polyepoxides.

A preferred class of olefin polymers is polybutenes, specifically polyisobutenes (PIB) or poly-n-butenes, such as may be prepared by polymerization of a $C_4$ refinery stream. Other preferred classes of olefin polymers are ethylene alpha-olefin (EAO) copolymers and alpha-olefin homo- and copolymers having in each case a high degree (e.g., >30%) of terminal vinylidene unsaturation, such as described in WO-94/13709, which may be functionalised and aminated to give dispersants.

Dispersants include, for example, derivatives of long chain hydrocarbon-substituted carboxylic acids, examples being derivatives of high molecular weight hydrocarbyl-substituted succinic acid. A noteworthy group of dispersants are hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195, 3,024,237; 3,219,666; and 3,216,936; and BE-A-66,875 that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

Anti-wear and Anti-Oxidant Agents

As previously indicated dihydrocarbyl dithiophosphate metal salts are frequently used in lubricants as anti-wear and antioxidant agents. In the present invention they are of particular value in that they act synergistically in combination with the detergents of the invention. The metal may be an alkali or alkaline earth metal, or aluminum, lead, tin, zinc, molybdenum, manganese, nickel or copper. The zinc salts are most commonly used in lubricating oil in amounts of 0.1 to 10, preferably 0.2 to 2, mass %, based upon the total weight of the lubricant. They may be prepared in accordance with known techniques by first forming a dihydrocarbyl dithiophosphoric acid (DDPA), usually by reaction of one or more alcohols or a phenol with $P_2S_5$ and then neutralising the formed DDPA with a zinc compound. The zinc dihydrocarbyl dithiophosphates can be made from mixed DDPA which in turn may be made from mixed alcohols. Alternatively, multiple zinc dihydrocarbyl dithiophosphates can be made and subsequently mixed.

Thus the dithiophosphoric acid containing secondary hydrocarbyl groups that is used may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates useful in the present invention are oil-soluble salts of dihydrocarbyl dithiophosphoric acids and may be represented by the following formula:

$$[(RO)(R^1O)P(S)S]_2Zn,$$

wherein R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. in R and $R^1$ together) in the dithiophosphoric acid will generally be 5 or greater. The zinc dihydrocarbyl dithiophosphate can therefore comprise zinc dialkyl dithiophosphates. At least 50 (mole) % of the alcohols used to introduce hydrocarbyl groups into the dithiophosphoric acids may be secondary alcohols.

Base Oil

The base oil (sometimes referred to as "base stock") is an oil of lubricating viscosity and is the primary liquid constituent of a lubricant, into which additives and possibly other oils are blended to produce the final lubricant (or lubricating composition).

A base oil is useful for making concentrates as well as for making lubricating oil compositions therefrom, and may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil, and heavy duty diesel oil. Generally, the viscosity of the oil ranges from 2 to 30, especially 5 to 20, $mm^2s^{-1}$ at 100° C.

Natural oils include animal oils and vegetable oils (e.g., castor and lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl) benzenes); polyphenyls (e.g., biphenyls, terphenyls, alkylated polyphenols); and alkylated diphenyl ethers and alkylated diphenyl sulfides and the derivatives; analogs and homologs thereof.

Alkylene oxide polymers and interpolymers and derivatives thereof where the terminal hydroxyl groups have been modified, for example by esterification or etherification, constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methylpolyisopropylene glycol ether having an average molecular weight of 1000, diphenyl ethers of poly-ethylene glycol having a molecular weight of 500–1000, diethyl ethers of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, disodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Silicon-based oils such as the polyalkyl-, polyaryl-, polyakoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butyl-phenyl)silicate, hexa-(4-methyl-2-pentoxy)disiloxane, poly(methyl)siloxanes and poly (methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Base oil may be categorised in Groups I to V according to the API EOLCS 1509 definition.

Concentrates, Compositions and Uses

In the preparation of lubricants, it is, as indicated above, common practice to introduce additive(s) therefor in the form of concentrates of the additive(s) in a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons are examples of suitable carrier fluids for concentrates.

Concentrates constitute a convenient means of handling additives before their use, as well as facilitating solution or dispersion of additive in lubricants. When preparing a lubricant that contains more than one type of additive (or "additive component"), each additive may be incorporated separately—each in the form of a concentrate. In many instances, however, it is convenient to provide a so-called additive "package" (also referred to as an "adpack") comprising two or more additives in a single concentrate.

A concentrate may contain 1 to 90, such as 10 to 80, preferably 20 to 80, more preferably 20 to 70, mass % active ingredient of the additive or additives.

Lubricants may be prepared by adding to a major amount of an oil of lubricating viscosity a mixture of an effective minor amount of at least one additive and, if necessary, one or more co-additives such as described herein. This preparation may be accomplished by adding the additive directly to the oil or by adding it in the form of a concentrate thereof to disperse or dissolve the additive. Additives may be added to the oil by any method known to those skilled in the art either prior to, contemporaneously with, or subsequent to addition of other additives.

By "major amount" in this specification is meant in excess of 50 mass % of the composition and by "minor amount" is meant 50 or less than 50 mass % of the composition, both in respect of the stated additive and of the total mass % of all of the additives present, reckoned as active ingredient of the additive or additives.

The terms "oil-soluble" or "dispersible", or cognate terms, used herein do not necessarily indicate that the or additives are soluble, dissolvable, miscible, or are capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricants may be used to lubricate mechanical engine components, particularly an internal combustion engine, by adding the lubricating oil thereto.

The lubricants and concentrates comprise defined components that may or may not remain the same chemically before and after mixing with an oleaginous carrier. This invention encompasses lubricants and concentrates which comprise the defined components before mixing, or after mixing, or both before and after mixing.

When concentrates are used to make lubricants, they may for example be diluted with 3 to 100, e.g. 5 to 40, parts by mass of oil of lubricating viscosity per part of the concentrate.

When lubricants contain one or more additives, each additive is typically blended into the base oil in an amount which enables the additive to provide its desired function. Representative effective amounts of such additives, when used in crankcase lubricants, are listed below. All the values listed are stated as mass per cent active ingredient.

| ADDITIVE | MASS % (Broad) | MASS % (Preferred) |
|---|---|---|
| Ashless Dispersant | 0.1–20 | 1–8 |
| Metal detergents | 0.1–6 | 0.2–4 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier 1 | 0.01–6 | 0–4 |
| Mineral or Synthetic Base Oil | Balance | Balance |

1. Viscosity modifiers are used only in multi-graded oils.

For non-crankcase applications, the quantities and/or proportions of the above additives may be varied; for example, marine diesel cylinder lubricants use relatively higher amounts of metal detergents, which may form 10–50 wt % of the lubricant.

It will be understood that the various components of the composition, essential as well as optimal and customary, may react under the conditions of formulation, storage, or use, and that the invention also provides the product obtainable or obtained as a result of any such reaction.

The final lubricant may contain from 5 to 25, preferably 5 to 18, typically 10 to 15 mass % of the concentrate, the remainder being oil of lubricating viscosity.

EXAMPLES

The invention will now be described by way of illustration only with reference to the following examples. In the examples, unless otherwise noted, all treat rates of all additives are reported as mass % active ingredient.

The examples will refer to the accompanying drawings in which

Figure 2:
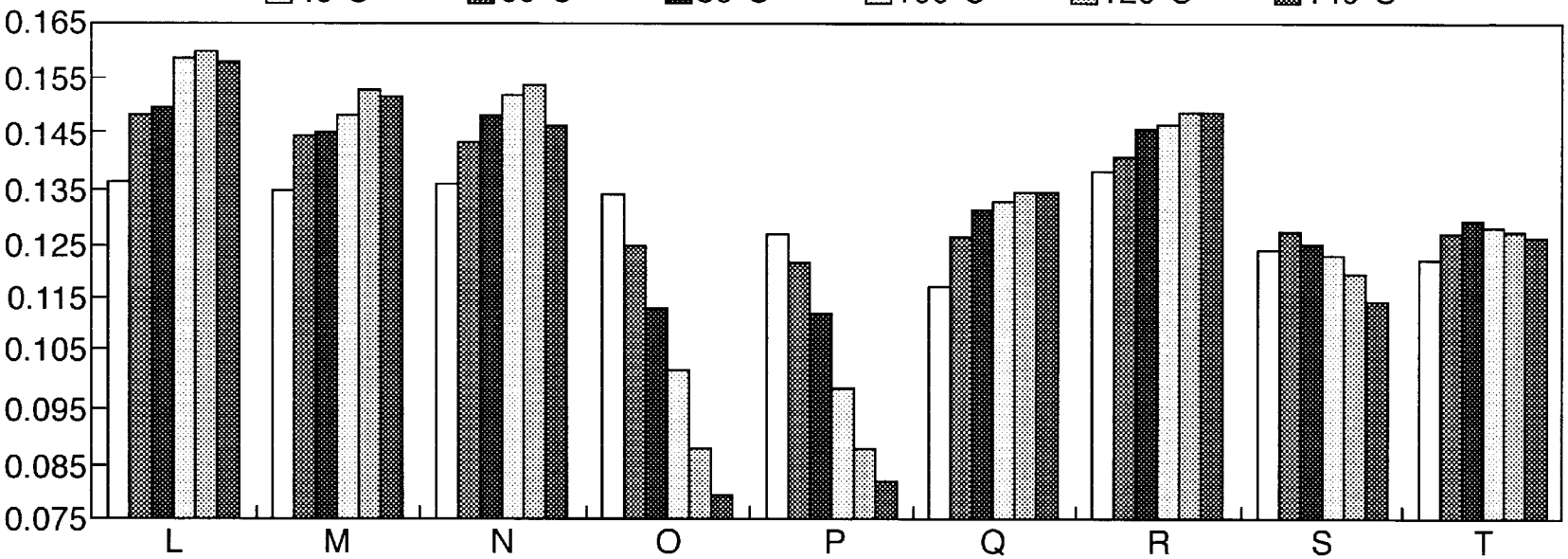

FIG. 1 is a bar chart depicting the coefficient of friction values obtained from the HFRR test (as described below) (given along the y-axis) at six successively increasing temperatures (40, 60, 80, 100, 120 and 140° C. moving from left to right along the x-axis) for each of formulations identified as A to K (indicated on the x-axis); and FIG. 2 is a bar chart that corresponds to FIG. 1, but for each of formulations identified as L to T.

Fr. PI 25–26

Test Procedure

A High Frequency Reciprocating Rig (HFRR), described in the Proceedings of the International Tribology Conference, Yokohama, Oct. 29 to Nov. 2, 1995.0 pages 817 to 822, was used.

The HFRR consists of a reciprocating upper specimen holder and a static lower specimen holder which can contain a lubricant. Metal specimens can be rubbed against each other in a reciprocating fashion. The lubricant temperature and specimen velocity are controlled within certain limits and the contact between the two specimens can be loaded by applying a dead weight on the upper specimen holder. The friction force in the direction of movement can be accurately measured and will normally be expressed as the ratio between the friction force and the normal force (dead weight force); this is the coefficient of friction, c.o.f. An average reading of the c.o.f. per stroke is electronically stored and displayed.

Thus the variation of friction with lubricant composition, temperature, load and average speed can be assessed by using the HFRR.

The results shown in FIGS. 1 and 2 were obtained using the following equipment, conditions and procedure:

specimens: AISI 52100 steel ball, 6 mm diameter, against flat steel disc stroke length 1 mm reciprocating frequency 20 Hz load 400 g temperature was changed stepwise from 40 to 140° C. in 20° C. increments Freshly cleaned specimens at 40° C. were rubbed against each other for 5 minutes and the temperature increased by 20° C. When the temperature was stable, rubbing recommenced for 5 minutes and the temperature increased by 20° C. The procedure was continued in incremental steps; after 5 minutes at 140° C. the test was complete. During each 5 minute period, the coefficient of friction was measured and recorded as an average for each temperature.

Examples 1–7

A series of overbased metal detergents according to the invention was prepared using the following procedure.

Toluene (342 g), water (27 g) and methanol (369 g) were charged to a 2 liter reactor and stirring commenced at room temperature. ESN 150 hydrocarbon diluent oil was also added. The amount of initial diluent oil used varied dependent on the amount of base oil present in the sulphonic acid to be added, and the amount of fatty acid amide to be added. The amount of initial diluent oil in Examples 1 to 7 (shown in the table below) was therefore derived so that the weight of the initial diluent oil, of the base oil in the sulphonic acid and of final diluent oil was 395 g.

Calcium hydroxide, in amounts shown in Table 1 below, was added to the reactor. The reaction mixture was heated to 40° C. and a high molecular weight sulphonic acid (amounts also shown in Table 1), diluted with toluene (150 g.), added. The resultant reaction mixture was cooled to 28° C. and carbon dioxide (106 g) continuously added at a rate of 200 ml/min, which addition took about 3 hours. The reactor contents temperature was then increased over 45 minutes to 60° C., which temperature was maintained for 1 hour. The apparatus was then changed to a distillation configuration and the volatile solvents and water distilled from the reaction mixture by gradually increasing the temperature to 125° C. at which point further ESN 150 diluent oil (184 g.) was added. The temperature was then increased to 160° C. when a vacuum of 150 mbar was applied to the reactor to help remove final traces of volatile solvent and water. A vacuum was applied for 60 minutes. A diatomaceous earth filter aid (2 mass %) was then added to the reaction products before filtering through a pressure filter, pre-coated with the same filter aid, maintained at 160° C.

TABLE 1

| Example | Sulphonic Acid Charge (g) | Lime Charge (g) | ESN 150 Initial Charge (g) | Amide | Amide Charge (g) | Sulphonate/Amide Mass Ratio |
|---|---|---|---|---|---|---|
| 1 | 390.3* | 224.9 | 53.5 | Oleamide | 47.6 | 25:5 |
| 2 | 312.1* | 222.2 | 85.7 | Oleamide | 95.2 | 20:10 |
| 3 | 234.1* | 219.6 | 117.2 | Oleamide | 142.8 | 15:15 |
| 4 | 200.7** | 221.2 | 157.3 | Oleamide | 114.2 | 18:12 |
| 5 | 391.7* | 225.6 | 51.1 | Oleamide | 112.8 | 23.4:11 |
| 6 | 289.0* | 221.2 | 95.0 | Stearamide | 114.2 | 18:12 |
| 7 | 289.0* | 221.2 | 95.0 | Erucamide | 114.2 | 18:12 |

* = 59.7 mass % high molecular weight alkyl benzene sulphonic acid in oil. Mol. Wt. of acid 670.

** = 83 mass % high molecular weight alkyl benzene sulphonic acid in oil. All products from examples 1 to 7 had total base numbers, measured by ASTM D-2896, between 295 and 320 mg KOH/g.

Example 8

The overbased metal detergents prepared as described in Examples 1 to 7 were evaluated in the compositions detailed in Table 2, where all figures represent mass %, to assess the boundary lubrication friction coefficients obtained over the temperature range of 40 to 140° C., as determined using the HFRR.

TABLE 2

| | A | B | C | D | E | F | G | H | I | J | K |
|---|---|---|---|---|---|---|---|---|---|---|---|
| Base oil | 94.10 | 92.60 | 94.50 | 92.60 | 94.10 | 92.60 | 94.10 | 92.60 | 94.10 | 92.60 | 93.88 |
| Ashless Dispersant | 3.74 | 3.74 | 3.74 | 3.74 | 3.74 | 3.74 | 3.74 | 3.74 | 3.74 | 3.74 | 3.74 |
| Conventional overbased detergent | 1.00 | 2.50 | — | — | — | — | — | — | — | — | — |
| Example 4 | — | — | 1.00 | 2.50 | — | — | — | — | — | — | — |

TABLE 2-continued

| | A | B | C | D | E | F | G | H | I | J | K |
|---|---|---|---|---|---|---|---|---|---|---|---|
| Example 3 | — | — | — | — | 1.00 | 2.50 | — | — | — | — | 1.00 |
| Example 7 | — | — | — | — | — | — | 1.00 | 2.50 | — | — | — |
| Example 6 | — | — | — | — | — | — | — | — | 1.00 | 2.50 | — |
| Oleamide | — | — | — | — | — | — | — | — | — | — | 0.23 |
| ZDDP A | 0.58 | 0.58 | 0.58 | 0.58 | 0.58 | 0.58 | 0.58 | 0.5B | 0.58 | 0.58 | 0.58 |
| ZDDP B | 0.58 | 0.58 | 0.58 | 0.58 | 0.58 | 0.58 | 0.58 | 0.58 | 0.58 | 0.58 | 0.58 |

Base oil=solvent neutral 100

Ashless dispersant=an unborated ashless dispersant prepared from an ethene-butene copolymer (molecular weight 3,250; ethene content 44 mass %; >30% terminal vinylidene unsaturation) that is functionalised by a carbonyl group introduced by the Koch reaction and subsequently aminated, as described in WO-A-94/13709.

Conventional overbased detergent=the detergent which is made by the described process without adding an amide, i.e. ~29 mass % sulfonate soap, (the metal is Ca)

ZDDP A=a zinc dialkyl dithiophosphate derived from mixed secondary C4 and iso C8 alcohols ZDDP B=a zinc dialkyl dithiophosphate derived from mixed iso C4/iso C5 alcohols Compositions A and B were known lubricant compositions. Compositions C to J were compositions of the invention. Composition K was for comparison purposes. Although Composition K contained 1.0 mass % of the product of Example 3, it also contained oleamide added after the preparation of the overbased detergent, rather than as an integral step in its preparation. The amount of added oleamide gave a total level of oleamide equivalent to that in Composition F, in which the total oleamide was included as a stabilising component in the preparation of the overbased detergent.

The results of measurement according to the HFRR test are shown as bar charts in FIG. 1. Each of the sets of bars represents the average value of the coefficient of friction at each of the temperatures displayed in the legend of FIG. 1.

Comparison of Composition K (comparative) with Composition F (invention) shows that the latter exhibits a very significant reduction in friction coefficient as temperature is increased, and that low friction coefficients are obtained at these elevated temperatures. In comparison, Composition K shows relatively high coefficients of friction at a given temperature. Composition K was also unsuited for use as a lubricant oil because immediately after blending it became hazy and gave rise to sediment.

Example 9

In this example, further compositions, L to T, were prepared to further demonstrate the synergistic effect of the use of the overbased detergents of the invention and metal dihydrocarbyl dithiophosphates. Table 3 details the constituents of the compositions, where all figures represent mass %'s.

TABLE 3

| | L | M | N | O | P | Q | R | S | T |
|---|---|---|---|---|---|---|---|---|---|
| Product of example 1 | 2.50 | 2.50 | 2.50 | 2.50 | 2.50 | 2.50 | — | — | — |
| Ashless | — | 4.00 | 7.00 | — | — | 7.00 | 7.00 | — | — |

TABLE 3-continued

| | L | M | N | O | P | Q | R | S | T |
|---|---|---|---|---|---|---|---|---|---|
| Dispersant | | | | | | | | | |
| ZDDPC | — | — | — | 0.40 | 1.20 | 1.20 | 1.20 | 0.40 | 1.20 |
| Base oil | 97.50 | 93.50 | 90.50 | 97.10 | 96.30 | 89.30 | 91.80 | 99.60 | 98.80 |

Base oil=solvent neutral 150

ZDDP C=a zinc dialkyl dithiophosphate derived from secondary C6 alcohol

Ashless dispersant=borated bis succinimide type ashless dispersant based on polyisobutylene of Mn=2225.

FIG. 2 illustrates the coefficient of friction obtained over the temperature range 40 to 140° C. for these compositions using the HFRR test.

What is claimed is:

1. An overbased metal detergent having friction-modifying properties comprising a stable, colloidal dispersion of inorganic base particles in an oil of lubricating viscosity, wherein the detergent comprises i) from 15 to 40 mass % of colloidal particles;

ii) from 20 to 45 mass % of a stabilising system comprising the mixture obtained by combining A) at least one oil-soluble detergent component having an anionic moiety selected from sulfonate, phenate, sulfurised phenate, thiophosphonate, salicylate, carboxylate, or naphthenate, and B) at least one aliphatic amide having from 16 to 24 carbon atoms, constituting from 25 to 75 mass % of the mixture; and iii) the oil of lubricating viscosity as the balance.

2. The detergent as claimed in claim 1 in combination with a metaldihydrocarbyl dithiophosphate wherein the mass ratio of metal detergent to dithiophosphate is from 25:1 to 1:2.

3. The detergent as claimed in claim 2 free of any molybdenum-containing component and containing sufficient metal dihydrocarbyl dithiophosphate to provide a detergent which has a boundary lubrication coefficient of friction of less than 0.1 measured at a temperature of at least 80° C. on a High Frequency Reciprocating Rig using the method and conditions specified in the Proceedings of the International Tribology Conference, Yokohama, Oct. 29 to Nov. 2, 1995, pages 817 to 822.

4. The detergent is claimed in claim 3 wherein the boundary lubrication friction coefficient is less than 0.09 measured at 120° C.

5. The detergent as claimed in claim 2, wherein the metal of the metal dihydrocarbyl dithiophosphate is zinc.

6. The detergent as claimed in claim 1 in combination with an ashless dispersant.

7. The detergent as claimed in claim 6 wherein the number average molecular weight of the ashless dispersant is at least 1500 and is less than 10,000.

8. The detergent as claimed in claim 1, wherein the amide is selected from oleamide, stearamide and erucamide.

9. The detergent as claimed in claim 1 in which the oil-soluble detergent component is selected from alkyl or alkaryl sulphonates in which the alkyl group has from 3 to 70 carbon atoms and the alkaryl group has from 9 to 80 carbon atoms.

10. The detergent as claimed in claim 1, wherein the inorganic base is a compound of an alkaline earth or alkali metal.

11. The detergent as claimed in claim 1 wherein the inorganic base is a carbonate.

12. A lubricant comprising, or made by admixing, a major amount of an oil of lubricating viscosity, and a minor amount of a detergent as claimed in claim 1.

13. A method of lubricating a spark-ignited engine or a compression-ignited engine which comprises supplying to the engine a lubricant as claimed in claim 12.

14. A method of making an overbased metal detergent comprising stably dispersing colloidal inorganic base particles in an oil of lubricating viscosity, using a mixture of at least one oil-soluble sulphonate, phenate, sulfurised phenate, thiophosphonate, salicylate, carboxylate, or naphthenate with at least one oil-soluble aliphatic amide having from 16 to 24 carbon atoms, wherein said aliphatic amide constitutes from 25 to 75% of said detergent.

15. The method as claimed in claim 14 comprising the steps of (a) neutralising (i) an oil-soluble detergent component selected from at least one of an hydrocarbyl sulphonate, carboxylate, phenate, sulphurised phenate, thiophosphonate, salicylate and naphthenate, with a stoichiometric excess of (ii) an alkaline earth or alkali metal oxide and/or hydroxide, in the presence of a volatile hydrocarbon solvent, water, a polar material and a non-volatile hydrocarbon solvent, (b) adding at least one aliphatic amide having from 16 to 24 carbon atoms to the neutralised product, wherein said at least one aliphatic amide constitutes from 25 to 75% of the mixture of said aliphatic amide and said detergent (c) reacting the product of step (b) with a gaseous acidic species, and (d) removing the volatile hydrocarbon solvent, water and the polar material.

16. The method as claimed in claim 15 wherein the gaseous acidic species is carbon dioxide.

17. The method as claimed in claim 15 wherein the amide is selected from oleamide, stearamide and erucamide.

* * * * *